US011202727B2

(12) United States Patent
Fukawatase et al.

(10) Patent No.: US 11,202,727 B2
(45) Date of Patent: Dec. 21, 2021

(54) WHEELCHAIR CARRYING VEHICLE

(71) Applicant: Toyota Jidosha Kabushiki Kaisha, Toyota (JP)

(72) Inventors: Osamu Fukawatase, Miyoshi (JP); Fumiko Nakai, Anjo (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/905,301

(22) Filed: Jun. 18, 2020

(65) Prior Publication Data

US 2021/0038448 A1 Feb. 11, 2021

(30) Foreign Application Priority Data

Aug. 8, 2019 (JP) ..... JP2019-146762

(51) Int. Cl.
*A61G 3/08* (2006.01)

(52) U.S. Cl.
CPC ..... *A61G 3/0808* (2013.01)

(58) Field of Classification Search
CPC ..... A61G 3/0808
USPC ..... 296/19
See application file for complete search history.

(56) References Cited

U.S. PATENT DOCUMENTS

2012/0219395 A1* 8/2012 Inaguma ..... A61G 3/08 414/556

FOREIGN PATENT DOCUMENTS

| | | | | |
|---|---|---|---|---|
| JP | H11113966 | A | | 4/1999 |
| JP | 2000-043718 | A | | 2/2000 |
| JP | 2004-168115 | A | | 6/2004 |
| JP | 2005-192740 | A | | 7/2005 |
| JP | 2014-188162 | A | | 10/2014 |
| JP | 2015-080658 | A | | 4/2015 |
| JP | 2015080658 | A | * | 4/2015 |

* cited by examiner

*Primary Examiner* — Joseph D. Pape
*Assistant Examiner* — Dana D Ivey
(74) *Attorney, Agent, or Firm* — Dinsmore & Shohl LLP

(57) ABSTRACT

Provided is a wheelchair carrying vehicle including: a hand rail provided in a support shaft, the hand rail being configured to be switchable between a usage position and a stored position when the support shaft rotates, the usage position being a position where the hand rail is placed near the chest of an occupant of a wheelchair, the stored position being a position where the hand rail is placed along a side wall of a vehicle cabin; and an impact absorption mechanism configured to, when a load equal to or more than a predetermined value is input from the occupant into the hand rail placed and fixed at the usage position, absorb at least part of the load by rotating the hand rail.

4 Claims, 10 Drawing Sheets

WHEELCHAIR CARRYING VEHICLE

CROSS-REFERENCE TO RELATED APPLICATIONS

This application claims priority to Japanese Patent Application No. 2019-146762 filed on Aug. 8, 2019, which is incorporated herein by reference in its entirety including the specification, drawings and abstract.

BACKGROUND

1. Technical Field

The present disclosure relates to a wheelchair carrying vehicle.

2. Description of Related Art

In terms of a wheelchair carrying vehicle configured to carry a wheelchair such that a wheelchair boarding space is formed by folding a rear seat and the wheelchair is put on the space, there has been conventionally known a structure in which a hand rail including a gripper to be gripped by an occupant of the wheelchair is provided in the wheelchair boarding space (e.g., see Japanese Unexamined Patent Application Publication No. 2005-192740 (JP 2005-192740 A)). The hand rail is configured to be switchable between a first state where the gripper is placed at a position (on a lateral side of the wheelchair) that does not disturb boarding of the wheelchair and a second state where the gripper is placed at a position (on the rear side of a seatback) where the gripper retracts from the lateral side of the rear seat when the rear seat is placed.

SUMMARY

In the meantime, the occupant of the wheelchair may change the hand rail from a stored position on the lateral side of the wheelchair to a usage position near the chest of the occupant so that the occupant can easily support himself or herself during running of the vehicle. However, at the time of heavy braking or a collision of the vehicle, the occupant of the wheelchair may hit the hand rail fixed at the usage position due to an inertia action, so that the occupant may receive an impact from the hand rail. Also, such a possibility is conceivable that the hand rail deforms due to the impact, so that the occupant falls from the wheelchair.

In view of this, an object of the present disclosure is to provide a wheelchair carrying vehicle that can relieve an impact to be received by an occupant of a wheelchair from a hand rail even when an inertia is applied to the occupant.

In order to achieve the above object, a wheelchair carrying vehicle according to a first aspect of the present disclosure includes a hand rail and an impact absorption mechanism. The hand rail is provided in a support shaft, and the hand rail is configured to be switchable between a usage position and a stored position when the support shaft rotates, the usage position being a position where the hand rail is placed in a vicinity of a chest of an occupant of a wheelchair, the stored position being a position where the hand rail is placed along a side wall of a vehicle cabin. The impact absorption mechanism is configured to, when a load equal to or more than a predetermined value is input from the occupant into the hand rail placed and fixed at the usage position, absorb at least part of the load by rotating the hand rail.

In the first aspect, when a load equal to or more than the predetermined value is input from the occupant of the wheelchair into the hand rail placed and fixed at the usage position due to an inertial action along with a collision or the like of the vehicle, for example, the hand rail is rotated by the impact absorption mechanism, and at least part of the load (impact energy) is absorbed. This accordingly relieves an impact to be received by the occupant from the hand rail even when an inertia is applied to the occupant of the wheelchair. Note that, the "vicinity of the chest" in the present disclosure indicates the front side of the chest of the occupant of the wheelchair when the chest is viewed from the occupant.

Further, the "wheelchair carrying vehicle" in the present disclosure indicates a general vehicle that can travel with an occupant of a wheelchair being carried by the vehicle regardless of whether the occupant needs to pay the fare or not. A vehicle for so-called mobility as a service (MaaS) including a self-driving bus or the like as an example is also included in the "wheelchair carrying vehicle" in the present disclosure.

Further, a wheelchair carrying vehicle according to a second aspect is as follows. That is, in the wheelchair carrying vehicle according to the first aspect, the impact absorption mechanism may be provided in the support shaft.

In the second aspect, the impact absorption mechanism is provided in the support shaft of the hand rail. This makes it possible to downsize the impact absorption mechanism, so that a large mounting space for the impact absorption mechanism is not required in the vehicle cabin.

Further, a wheelchair carrying vehicle according to a third aspect is as follows. That is, in the wheelchair carrying vehicle according to the first aspect or the second aspect, the hand rail may be configured to rotate to a vicinity of knees of the occupant when the load equal to or more than the predetermined value is input into the hand rail.

In the third aspect, when the hand rail rotates toward the vicinity of the knees of the occupant, at least part of the load (impact energy) input into the hand rail is absorbed. Further, it is possible to prevent the occupant from falling from the wheelchair by the hand rail rotating to the vicinity of the knees of the occupant. Note that, the "vicinity of the knees" in the present disclosure indicates a region from the thighs of the occupant of the wheelchair to the upper sides of the knees when the knees are viewed from the occupant.

Further, a wheelchair carrying vehicle according to a fourth aspect is as follows. That is, in the wheelchair carrying vehicle according to the third aspect, the hand rail may include at least either one of a hand rail for an occupant of a wheelchair who is seated in a forward facing posture relative to an advancing direction and a hand rail for an occupant of a wheelchair who is seated in a rearward facing posture relative to the advancing direction. The support shaft provided with the hand rail for the occupant of the wheelchair who is seated in a forward facing posture may be inclined outward in the vehicle width direction and forward in the vehicle front-rear direction from the vertical direction. The support shaft provided with the hand rail for the occupant of the wheelchair who is seated in a rearward facing posture may be inclined outward in the vehicle width direction and rearward in the vehicle front-rear direction from the vertical direction.

In the fourth aspect, with just a simple configuration to incline the support shaft, it is possible to prevent the occupant from falling from the wheelchair by the hand rail provided in the support shaft.

As described above, with the present disclosure, even when an inertia is applied to an occupant of a wheelchair, it is possible to relieve an impact to be received by the occupant from the hand rail.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

The following describes an embodiment of the present disclosure in detail with reference to the drawings. Note that, for purposes of this description, an arrow UP illustrated appropriately in each drawing indicates the upper side in the vehicle up-down direction, an arrow FR indicates the front side in the vehicle front-rear direction, and an arrow RH indicates the right side in the vehicle width direction. Accordingly, in the following description, in a case where the upper and lower sides, the front and rear sides, and the right and left sides are described without any special description, they respectively indicate the upper and lower sides in the vehicle up-down direction, the front and rear sides in the vehicle front-rear direction, and the right and left sides in the vehicle right-left direction (the vehicle width direction).

Further, a view from the vehicle width direction is referred to as a "side view." Further, the present embodiment will be described by taking, as an example, a self-driving bus (hereinafter just referred to as a "bus") 10 as a wheelchair carrying vehicle. Further, in the following description, a state (posture) facing forward along an advancing direction of the bus 10 is referred to as a "forward facing posture," and a state (posture) facing rearward along the advancing direction of the bus 10 is referred to as a "rearward facing posture."

Figure 1:
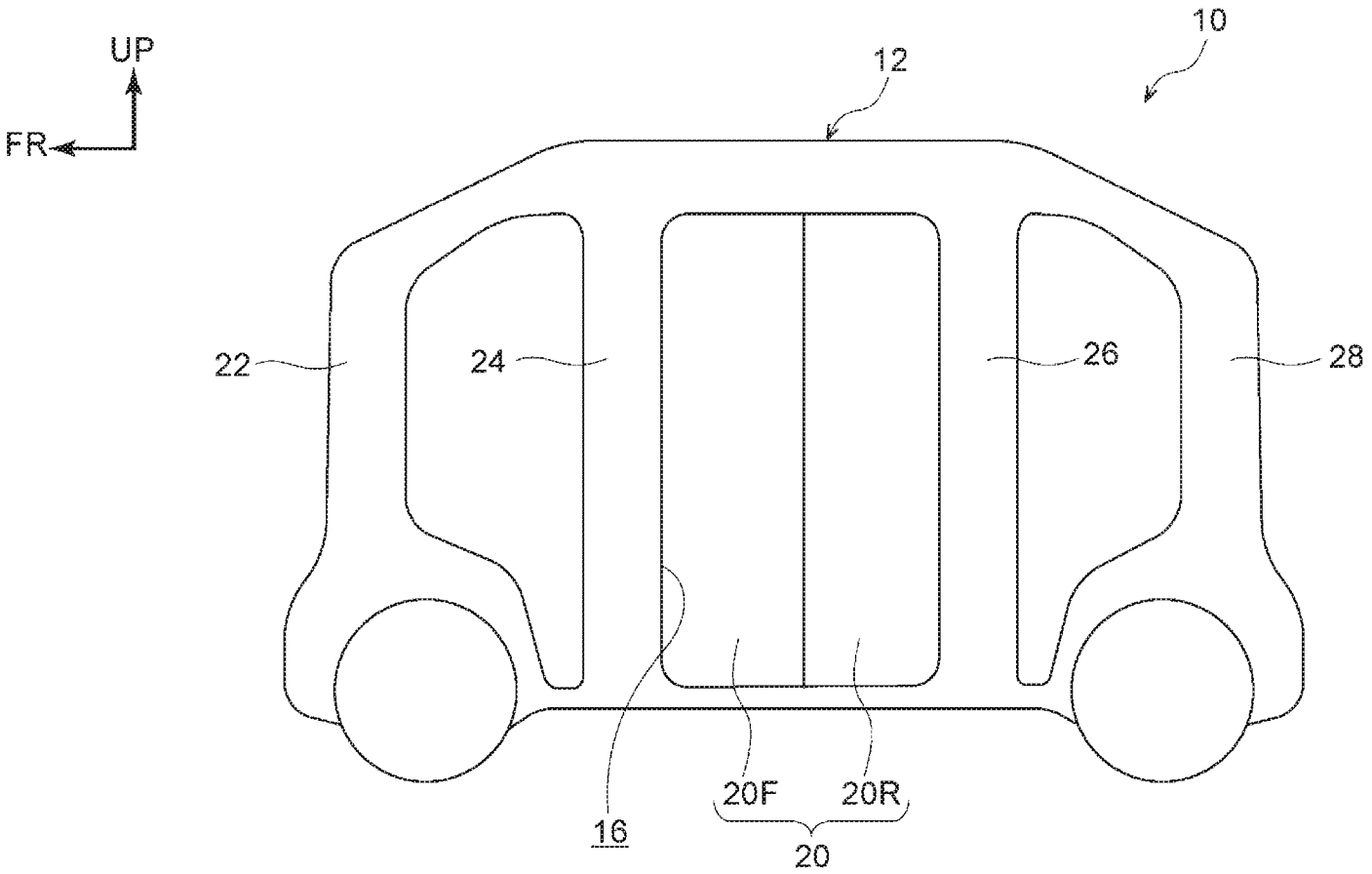
FIG. 1 is a side view illustrating a bus provided with a hand rail for a wheelchair according to the present embodiment.

As illustrated in FIG. 1, the bus 10 includes a pair of right and left first pillars 22, a pair of right and left fourth pillars 28, a pair of right and left second pillars 24, and a pair of right and left third pillars 26. The first pillars 22 are provided in a front part (a front end portion) of a vehicle body 12 such that the first pillars 22 extend in the up-down direction. The fourth pillars 28 are provided in a rear part (a rear end portion) of the vehicle body 12 such that the fourth pillars 28 extend in the up-down direction. The second pillars 24 are provided behind the first pillars 22 and in front of the third pillars 26 (described later) such that the second pillars 24 extend in the up-down direction. The third pillars 26 are provided in front of the fourth pillars 28 and behind the second pillars 24 such that the third pillars 26 extend in the up-down direction.

Figure 2:
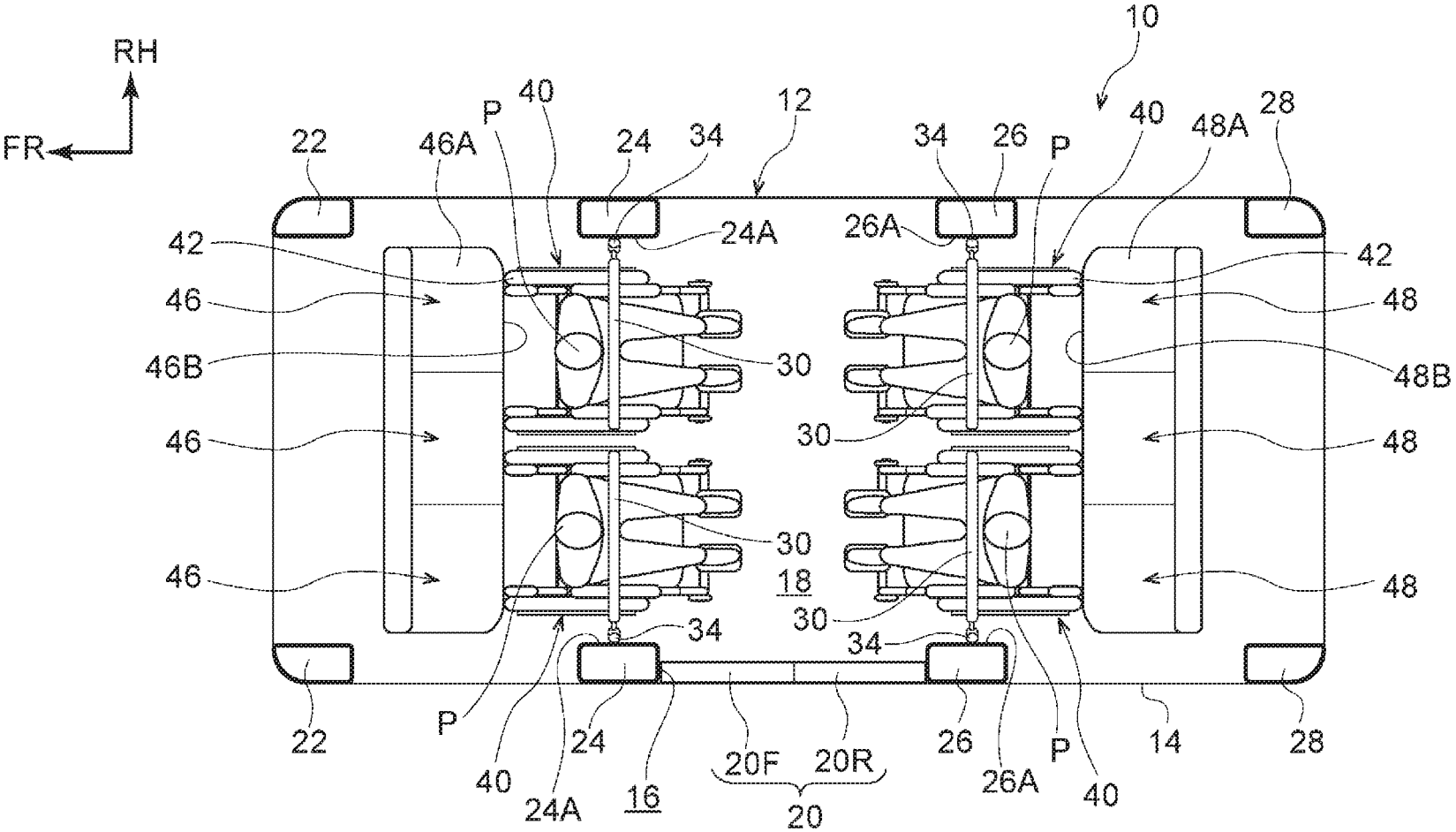
FIG. 2 is a plan view illustrating the inside of the bus provided with the hand rail for the wheelchair according to the present embodiment, together with occupants of wheelchairs.

As illustrated in FIG. 2, in a plan sectional view, the right and left first pillars 22 are each formed generally in a rectangular closed sectional shape in which its longitudinal direction is along the front-rear direction and a part on the outer side in the vehicle width direction and the front side is formed in an arch shape. Similarly, in a plan sectional view, the right and left fourth pillars 28 are each formed generally in a rectangular closed sectional shape in which its longitudinal direction is along the front-rear direction and a part on the outer side in the vehicle width direction and the rear side is formed in an arch shape. Further, in a plan sectional view, the right and left second pillars 24 and the right and left third pillars 26 are each formed in a rectangular closed sectional shape the longitudinal direction of which is along the front-rear direction.

Further, as illustrated in FIGS. 1, 2, the bus 10 includes an entrance door 20 configured to open and close a doorway 16 provided on a left side wall 14 of the vehicle body 12 and between the second pillar 24 and the third pillar 26. The entrance door 20 is configured to be dividable at a central part in the front-rear direction, and when a front door 20F and a rear door 20R slide forward and rearward, respectively, the doorway 16 is opened.

Further, as illustrated in FIG. 2, on a front wall side of the vehicle cabin 18, a plurality of (e.g., three) front seats 46 on which an occupant (not shown) except an occupant P of a wheelchair 40 (described later) is to be seated in a semi-upright posture and in a rearward facing posture is provided integrally along the vehicle width direction. On a rear wall side of the vehicle cabin 18, a plurality of (e.g., three) rear seats 48 on which an occupant except the occupant P of the wheelchair 40 (described later) is to be seated in a semi-upright posture and in a forward facing posture is provided integrally along the vehicle width direction.

The front seat 46 includes a seating face 46A on which the occupant is seated, and a flat-shaped positioning portion 46B integrally extending downward from a front end portion of the seating face 46A. Similarly, the rear seat 48 includes a seating face 48A on which the occupant is seated, and a flat-shaped positioning portion 48B integrally extending downward from a front end portion of the seating face 48A.

Accordingly, the occupant P of the wheelchair 40 boarding the bus 10 is seated behind the front seat 46 in a rearward facing posture or is seated in front of the rear seat 48 in a forward facing posture. At this time, a part (e.g., a pair of right and left main wheels 42) of the wheelchair 40 is brought into contact with a corresponding one of the positioning portions 46B, 48B. Hereby, the wheelchair 40 is placed in a positioned (fixed) state.

Further, a support member (not shown) configured to rotatably support a support shaft 34 is provided at a predetermined position on each of an inner wall surface 24A, of the second pillar 24, that faces inward in the vehicle width direction and an inner wall surface 26A, of the third pillar 26, that faces inward in the vehicle width direction. A hand rail 30 for the occupant P of the wheelchair 40 boarding at the above position is integrally attached to the support shaft 34. The support member is formed to have a generally "C-shaped" section into which the support shaft 34 is inserted in a movable manner in the axial direction, for example.

Note that, since the hand rail 30 placed on the inner wall surface 24A side of the second pillar 24 and the hand rail 30 placed on the inner wall surface 26A side of the third pillar 26 have the same configuration, the following description deals with the hand rail 30 placed on the inner wall surface 26A side of the left third pillar 26 as an example. That is, the following describes the hand rail 30 provided for the occupant P of the wheelchair 40 boarding on the left side in front of the rear seat 48 in a forward facing posture.

As illustrated in FIGS. 3 to 6, the hand rail 30 is integrally attached to an outer peripheral surface of the support shaft 34 having a columnar shape. The hand rail 30 includes a hand rail main body 32 formed in a columnar shape, and a columnar connecting portion 33 having a diameter smaller than that of the hand rail main body 32 and configured to integrally connect the hand rail main body 32 to the outer peripheral surface of the support shaft 34. Note that the length of the hand rail main body 32 is longer than the width (the length along the vehicle width direction) of the wheelchair 40 except the right and left main wheels 42 and a hand rim 44.

The support shaft 34 is rotatably supported by the support member (not shown) provided to project from the inner wall surface 26A of the third pillar 26. In a front view illustrated in FIG. 5, the upper side of the support shaft 34 is inclined outward in the vehicle width direction from the vertical direction, and in a side view illustrated in FIG. 6, the upper side of the support shaft 34 is inclined forward from the vertical direction. Note that those inclinations are a slight inclination of around 10 degrees, for example, but in FIGS. 3 to 8, the inclinations are illustrated in an exaggerated manner.

Figure 3:
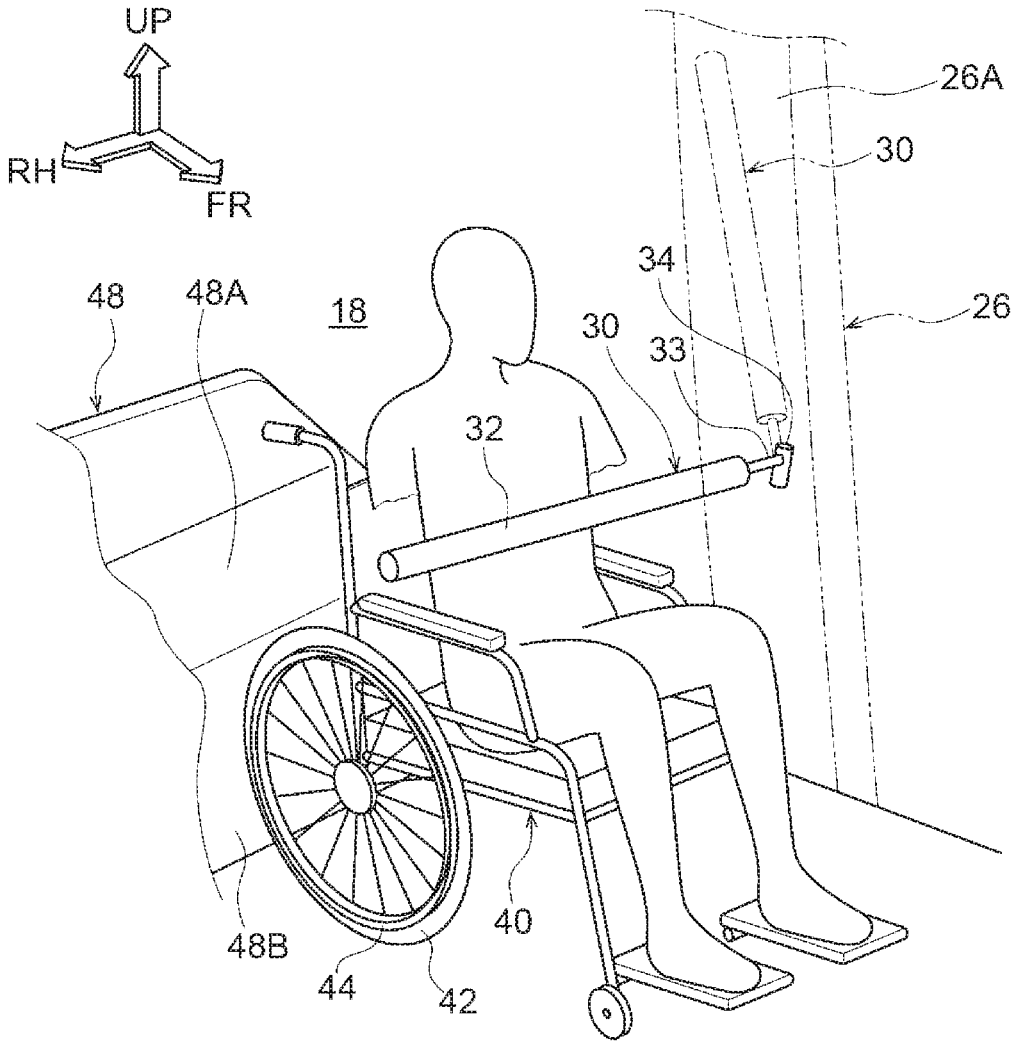
FIG. 3 is a perspective view illustrating a usage state of the handrail for the wheelchair according to the present embodiment, together with an occupant of a wheelchair.
Figure 4:
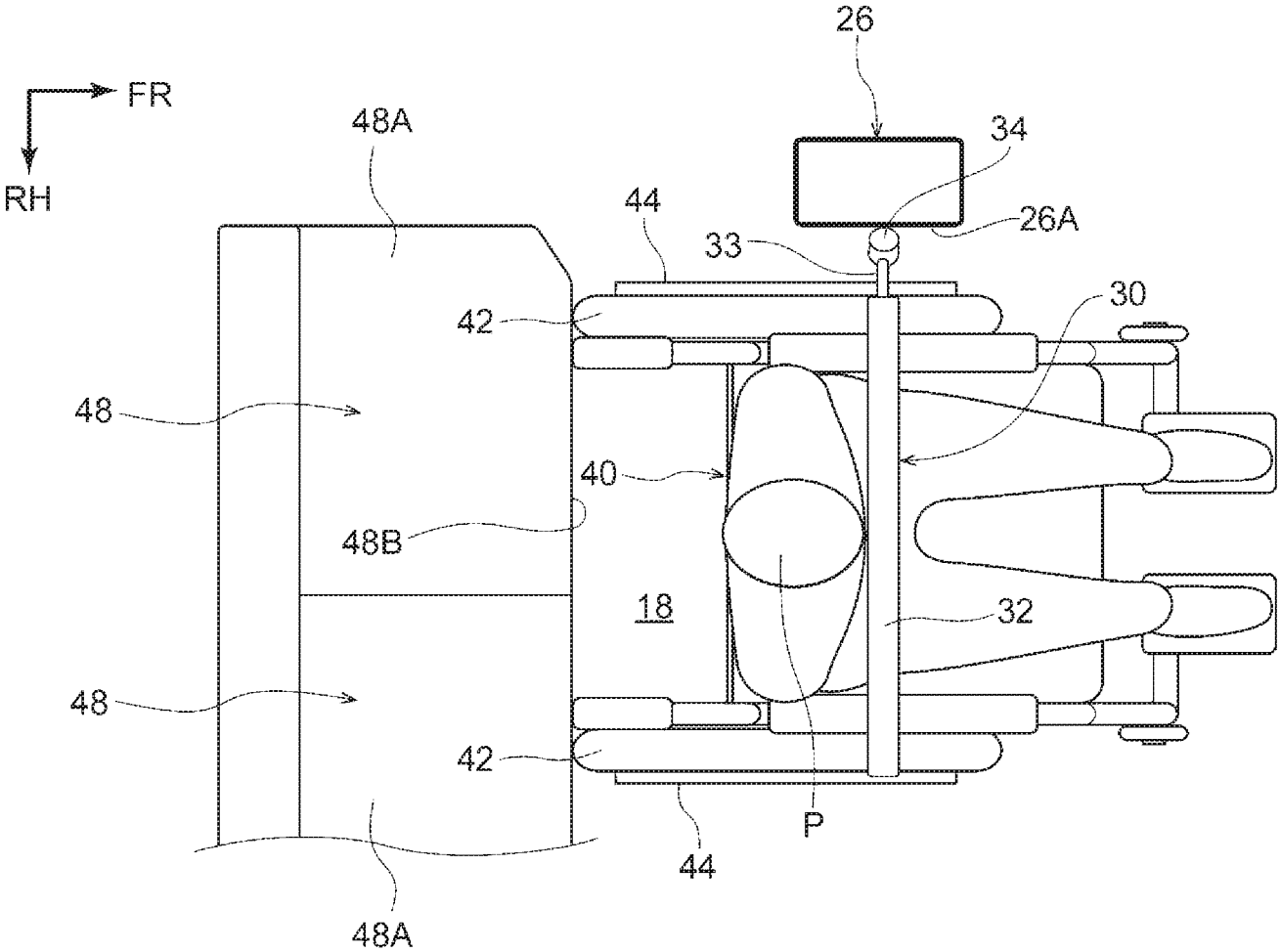
FIG. 4 is a plan view illustrating the usage state of the handrail for the wheelchair according to the present embodiment, together with the occupant of the wheelchair.
Figure 5:
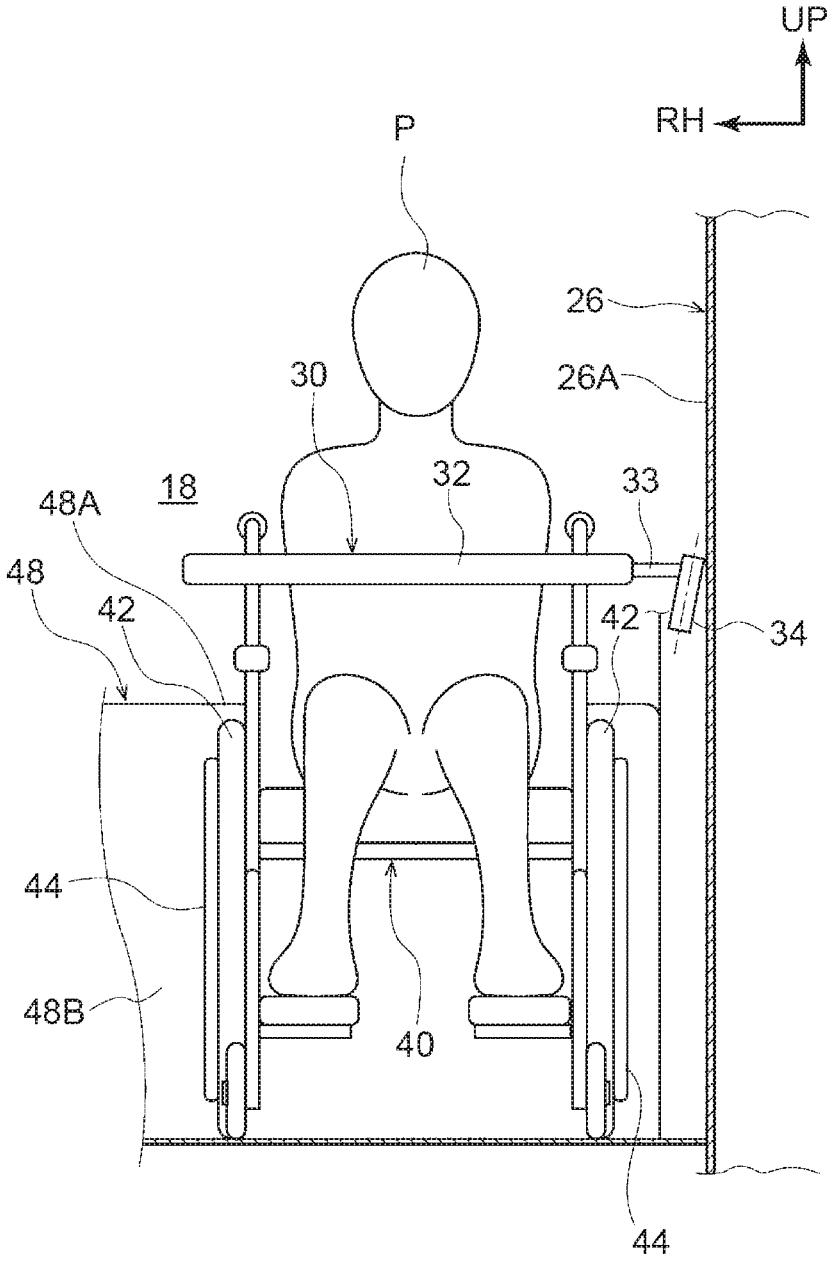
FIG. 5 is a front view illustrating the usage state of the handrail for the wheelchair according to the present embodiment, together with the occupant of the wheelchair.
Figure 6:
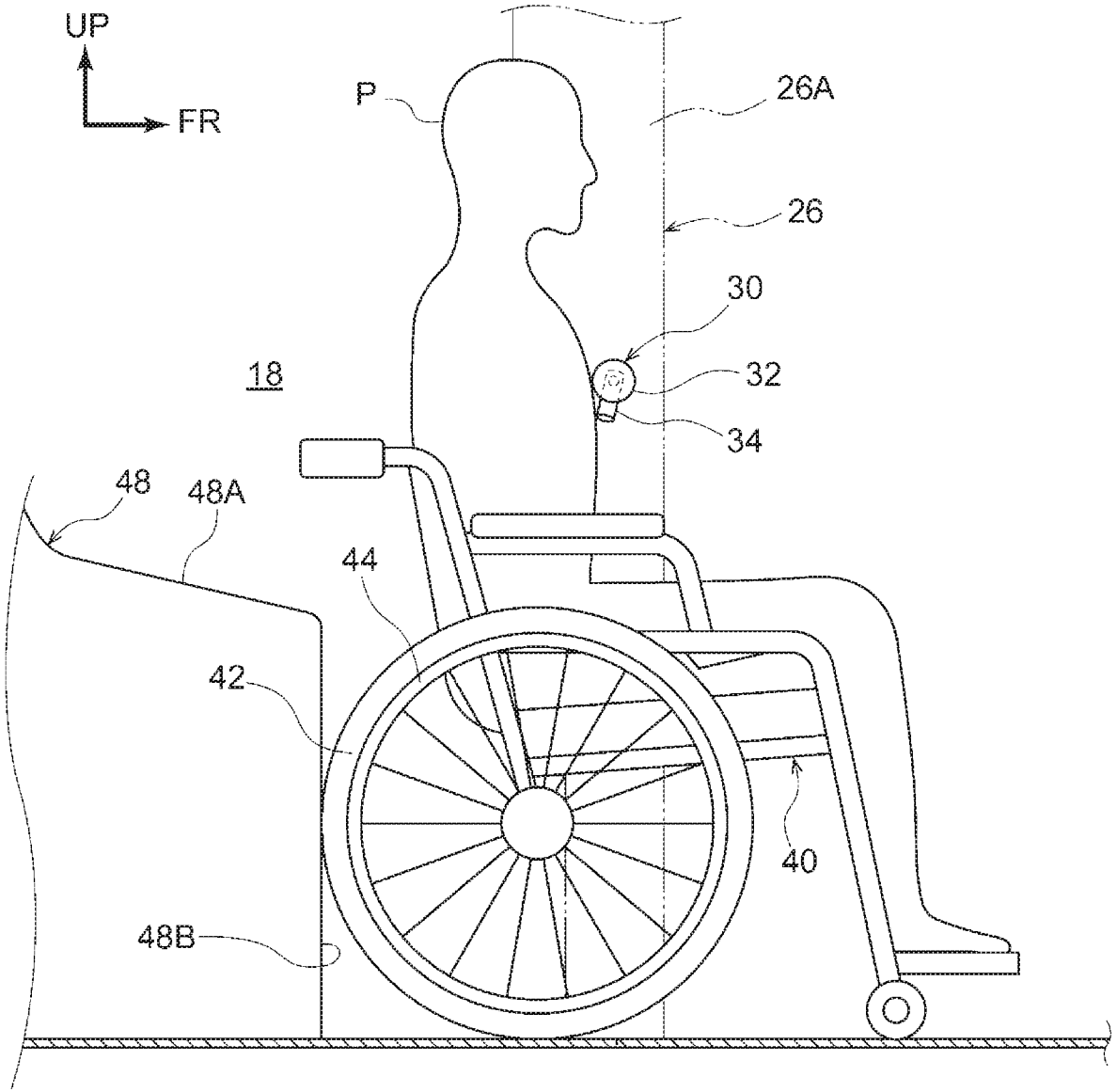
FIG. 6 is a side view illustrating the usage state of the handrail for the wheelchair according to the present embodiment, together with the occupant of the wheelchair.

As illustrated in FIG. 3, the hand rail 30 is configured to be switchable between a usage position and a stored position (indicated by a virtual line) by rotating the hand rail 30 around the support shaft 34 by about 90 degrees. At the usage position, the hand rail 30 is placed near the chest of the occupant P of the wheelchair 40. At the stored position, the hand rail 30 is placed along an upper part of the inner wall surface 26A (a side wall of the vehicle cabin 18) of the third pillar 26.

Figure 8:
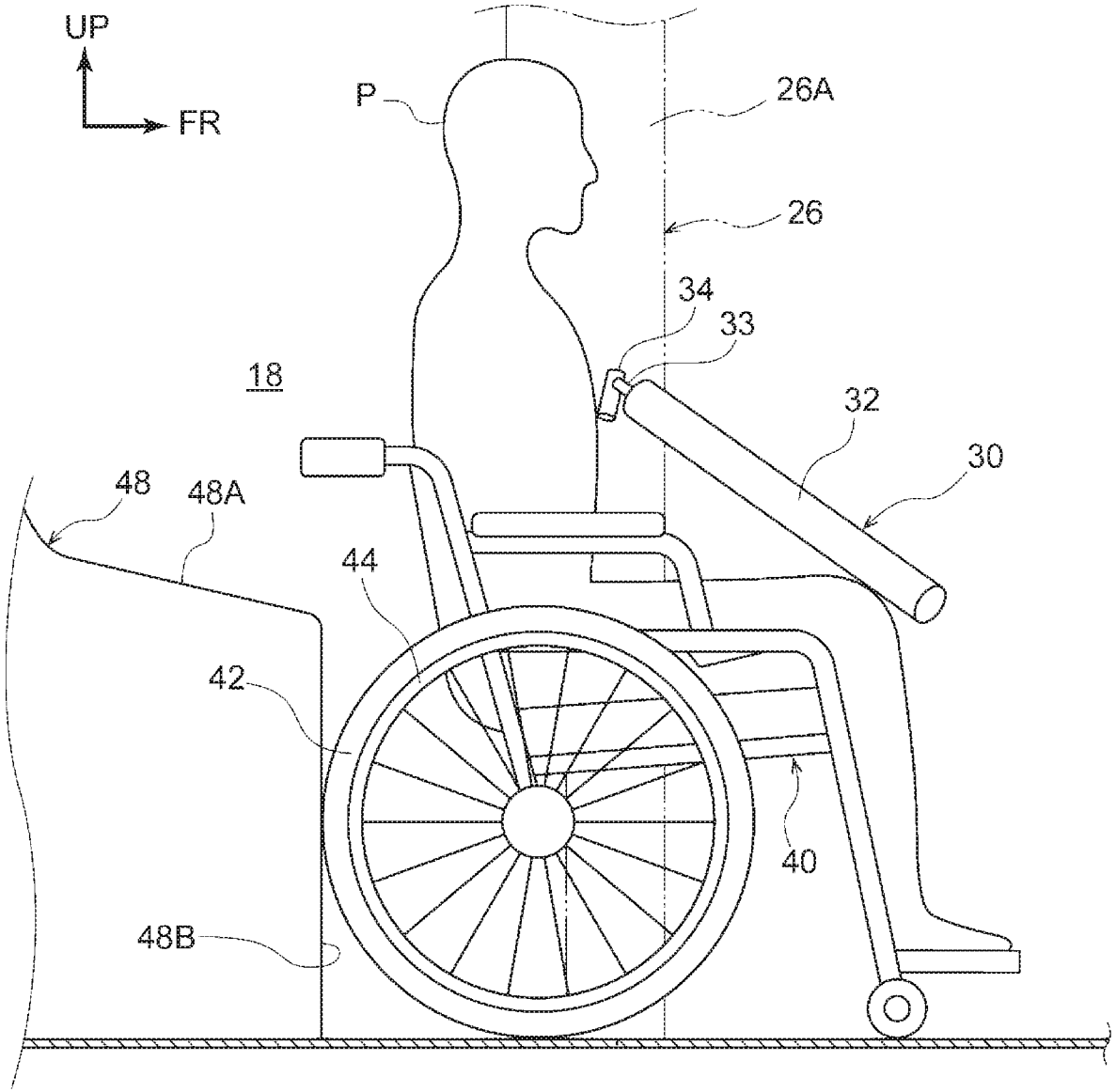
FIG. 8 is a side view illustrating the rotated state of the handrail for the wheelchair according to the present embodiment, together with the occupant of the wheelchair.
Figure 9B:
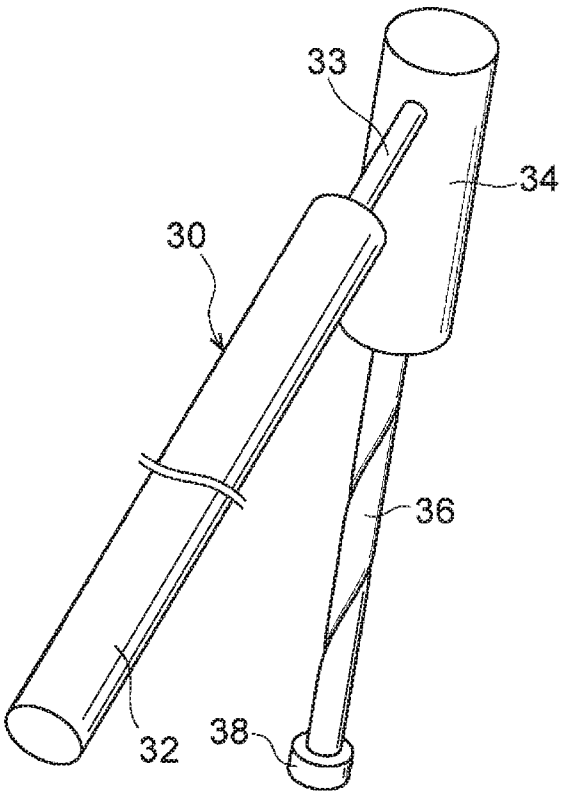
FIG. 9B is a perspective view illustrating, in an enlarged manner, a state of the impact absorption mechanism (the torsion bar spring) when the handrail for the wheelchair according to the present embodiment rotates.
Figure 9A:
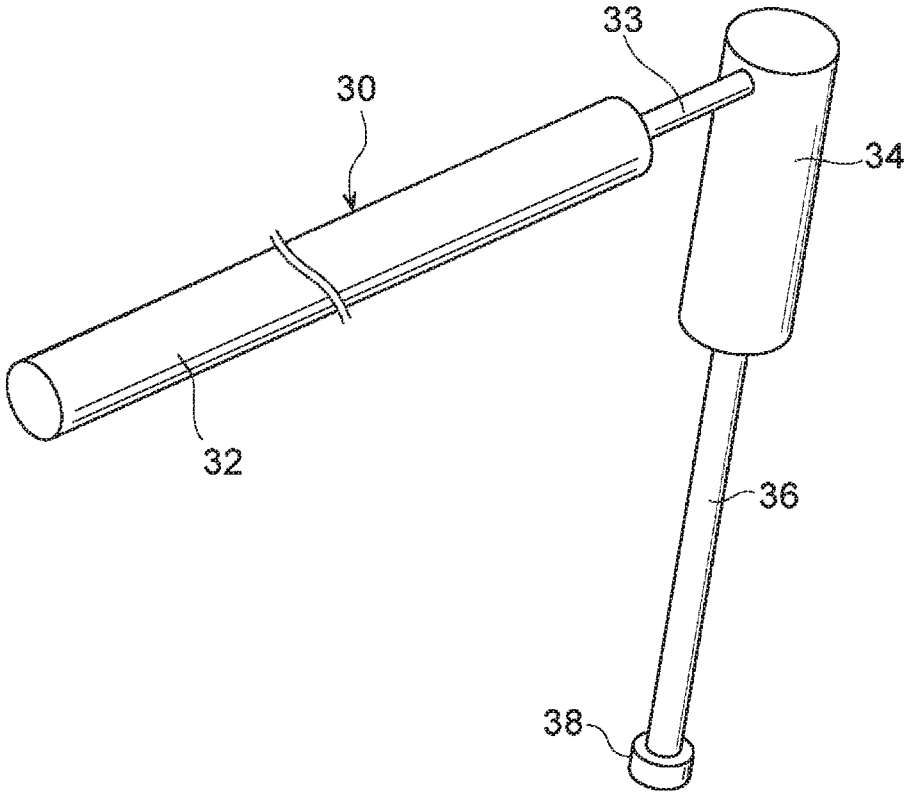
FIG. 9A is a perspective view illustrating the handrail for the wheelchair according to the present embodiment and an impact absorption mechanism (a torsion bar spring) in an enlarged manner.

More specifically, as illustrated in FIG. 9A, the support shaft 34 is configured to be slidable in its axial direction in a state where the support shaft 34 is supported by the support member, and the support shaft 34 is detachable from an upper part of a fixing shaft 36 provided below the support shaft 34. Note that, in FIGS. 3 to 8, the fixing shaft 36 is not illustrated.

The fixing shaft 36 is formed to have a diameter smaller than that of the support shaft 34 and is placed coaxially with the support shaft 34. A lower part of the support shaft 34 is configured such that the upper part of the fixing shaft 36 is relatively insertable into the lower part of the support shaft 34. One or more recessed grooves (not shown) along the axial direction are formed on an inner peripheral surface of the lower part of the support shaft 34, and one or more projecting portions (not shown) fitted into the recessed grooves are formed on an outer peripheral surface of the upper part of the fixing shaft 36.

Accordingly, when the upper part of the fixing shaft 36 is relatively inserted into the lower part of the support shaft 34, the projection portions of the fixing shaft 36 are fitted into the recessed grooves of the support shaft 34. Thus, the support shaft 34 is locked (fixed) by the fixing shaft 36 such that the support shaft 34 is non-rotatable by a load (impact energy) less than a predetermined value (e.g., 250 N).

That is, when the support shaft 34 is slid upward in the axial direction, the upper part of the fixing shaft 36 is not relatively inserted into the lower part of the support shaft 34. Accordingly, the support shaft 34 rotates while the support shaft 34 is supported by the support member, so that the support shaft 34 can take the usage position and the stored position. At the usage position, the support shaft 34 is slid downward in the axial direction, and the upper part of the fixing shaft 36 is relatively inserted into the lower part of the support shaft 34. Hereby, the support shaft 34 is locked so that the hand rail 30 does not rotate unexpectedly.

Further, the fixing shaft 36 is a so-called torsion bar spring, and a support base 38 having a diameter larger than that of the fixing shaft 36 is integrally and coaxially provided in a lower end portion of the fixing shaft 36. The support base 38 is fixed to the vehicle body 12. Accordingly, when a load equal to or more than the predetermined value (e.g., 250 N) is input into the hand rail 30 toward the front side, the fixing shaft 36 elastically deforms to twist as illustrated in FIG. 9B in an exaggerated manner, thereby allowing the hand rail 30 to rotate.

Figure 7:
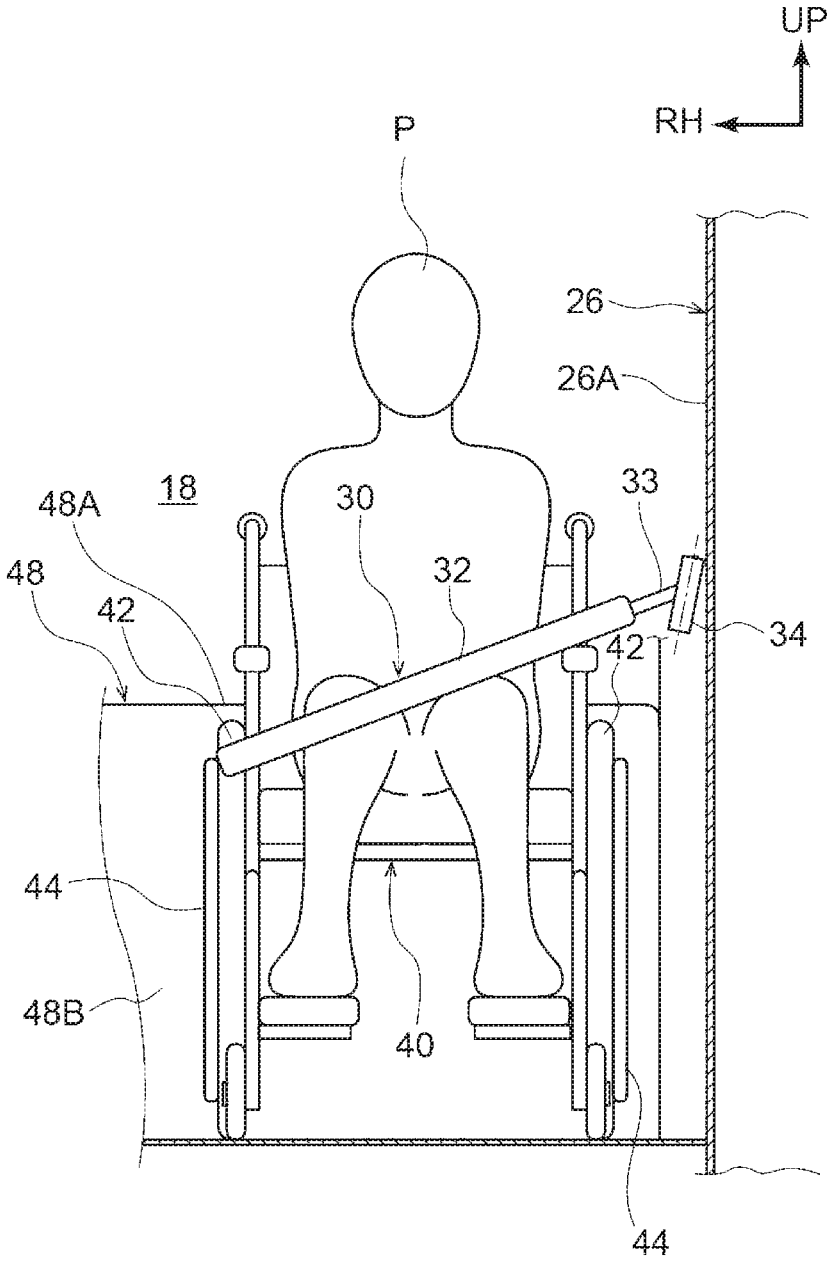
FIG. 7 is a front view illustrating a rotated state of the handrail for the wheelchair according to the present embodiment, together with the occupant of the wheelchair.

That is, the fixing shaft 36 relatively inserted into the support shaft 34 (provided in the support shaft 34) constitutes an impact absorption mechanism configured to, when a load equal to or more than the predetermined value is input from the occupant P of the wheelchair 40 into the hand rail 30 placed and fixed at the usage position, absorb at least part of the load by rotating the hand rail 30. Note that, at this time, since the support shaft 34 is inclined, the hand rail 30 rotates toward the vicinity of the knees of the occupant P as illustrated in FIGS. 7, 8.

Next will be described operations in the bus 10 configured as described above.

As illustrated in FIG. 2, the occupant P of the wheelchair 40 boarding the bus 10 is seated behind the front seat 46 in a rearward facing posture or is seated in front of the rear seat 48 in a forward facing posture. Note that, at this time, the main wheels 42 of the wheelchair 40 are brought into contact with the positioning portion 46B of the front seat 46 or the positioning portion 48B of the rear seat 48, so that the position of the wheelchair 40 is determined.

In this state, the occupant P of the wheelchair 40 moves the hand rail 30 from the stored position to the usage position. That is, when the hand rail 30 placed on the inner wall surface 26A side of the left third pillar 26 as illustrated in FIG. 3 is taken as an example, the occupant P grips the hand rail main body 32 of the hand rail 30 placed in the upper part of the inner wall surface 26A of the third pillar 26, and the occupant P rotates the hand rail 30 downward around the support shaft 34.

At this time, the support shaft 34 is rotated in a state where the support shaft 34 is supported by the support member. When the occupant P rotates the hand rail 30 downward to the usage position in a state where the occupant P is gripping the hand rail main body 32, the occupant P then slides the hand rail 30 downward in the axial direction of the support shaft 34. Hereby, the upper part of the fixing shaft 36 is relatively inserted into the lower part of the support shaft 34, so that the projection portions of the fixing shaft 36 are fitted into the recessed grooves of the support shaft 34.

Thus, as illustrated in FIGS. 3 to 6, the hand rail 30 is fixed to the usage position. That is, the hand rail main body 32 is placed generally horizontally in the vicinity of the chest of the occupant P. Note that the length of the hand rail main body 32 is longer than the width of the wheelchair 40 except the right and left main wheels 42 and the hand rim 44. Accordingly, the occupant P of the wheelchair 40 can grip the hand rail main body 32 by both hands as well as by either the right hand or the left hand, thereby easily securing safety during running of the bus 10.

In the meantime, when the bus 10 has a front end collision, for example, the occupant P of the wheelchair 40 who is seated in front of the rear seat 48 in a forward facing posture is to move forward due to an inertial action along with the front end collision. That is, a load equal to or more than the predetermined value (e.g., 250 N) is input from the occupant P into the hand rail 30 toward the front side, the hand rail 30 being placed at the usage position.

As a result, as illustrated in FIG. 9B, the fixing shaft 36 as the impact absorption mechanism (the torsion bar spring) elastically deforms to twist, thereby allowing the hand rail 30 (the hand rail main body 32) to rotate forward and downward (rotate toward the vicinity of the knees of the occupant P) as illustrated in FIGS. 7, 8.

Hereby, at least part of the load (impact energy) input into the hand rail 30 is absorbed by the elastic deformation of the fixing shaft 36 that allows the hand rail 30 to rotate, thereby reducing an injury level to be received by the occupant P from the hand rail 30. That is, even when an inertia directed forward is applied to the occupant P of the wheelchair 40 due to a collision or the like of the bus 10, it is possible to relieve an impact to be received by the occupant P from the hand rail 30.

Note that, since the support shaft 34 is inclined as described above, the hand rail 30 (the hand rail main body 32) absorbs the load (impact energy) while the hand rail 30 is rotating to the vicinity of the knees of the occupant P. Further, since the hand rail 30 rotates toward the vicinity of the knees of the occupant P, it is possible to prevent, by the hand rail 30 (the hand rail main body 32) thus rotating, the occupant P to move forward due to the inertial action from falling from the wheelchair 40.

Besides, such an effect can be yielded only by a simple configuration to incline the support shaft 34, thereby also making it possible to restrain an increase in a manufacturing cost. Further, as described above, the fixing shaft 36 as the impact absorption mechanism is just provided for the support shaft 34 of the hand rail 30, and this can achieve downsizing of the impact absorption mechanism. That is, there is such an advantage that a large mounting space for providing the impact absorption mechanism is not required in the vehicle cabin 18 of the bus 10.

Further, the impact absorption mechanism is not limited to the fixing shaft 36 as a torsion bar spring illustrated in FIGS. 9A, 9B. The impact absorption mechanism may be constituted by a damper mechanism 50 illustrated in FIGS. 10A, 10B, for example. More specifically, as illustrated in FIG. 10A, the damper mechanism 50 is integrally provided in a lower part of a fixing shaft 37. Note that the fixing shaft 37 does not have a function as a torsion bar spring, but the other configuration thereof is equivalent to that of the fixing shaft 36.

Figure 10B:
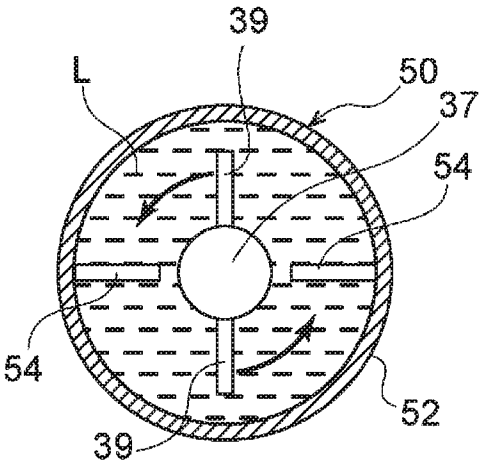
FIG. 10B is an enlarged arrow sectional view taken along a line X-X in FIG. 10A.
Figure 10A:
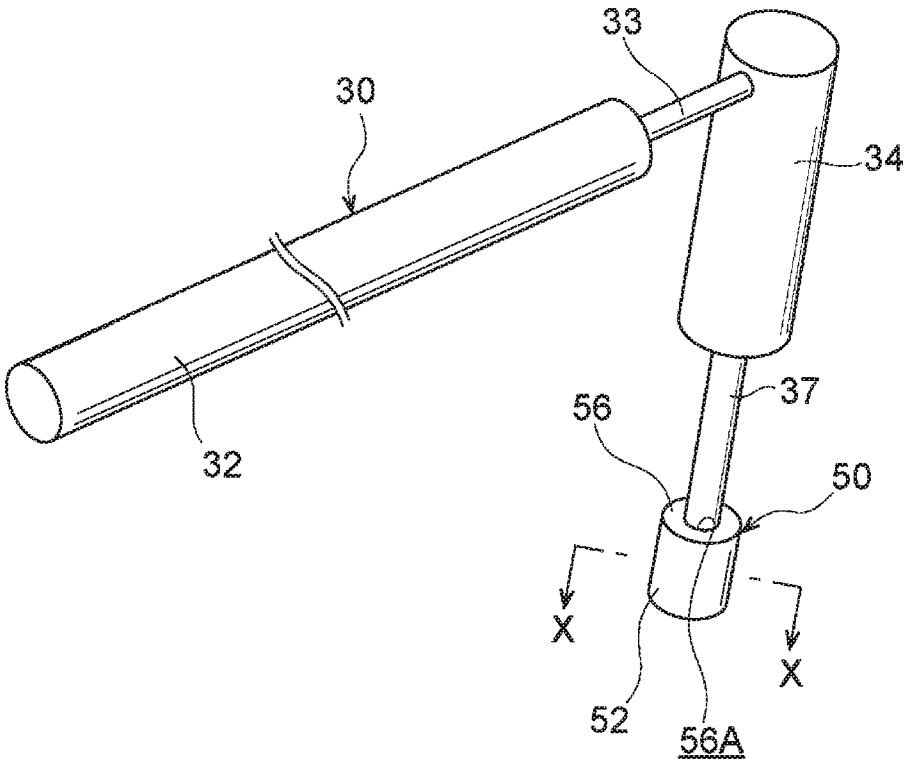
FIG. 10A is a perspective view illustrating a modification of the handrail for the wheelchair according to the present embodiment and the impact absorption mechanism in an enlarged manner.

As illustrated in FIG. 10B, the damper mechanism 50 includes a hollow columnar case 52, and highly viscous oil L is filled in the case 52. Further, two partition walls 54 are provided on an inner peripheral surface of the case 52 in a projecting manner toward the center (the inner side in the radial direction) such that the partition walls 54 face each other.

Two blade members 39 are provided on an outer peripheral surface of a lower end portion of the fixing shaft 37 so as to project toward the opposite sides by 180 degrees, and a through-hole 56A through which the lower end portion of the fixing shaft 37 is inserted is formed in a central part of an upper wall 56 of the case 52 (see FIG. 10A). Accordingly, the lower end portion of the fixing shaft 37 including the blade members 39 is placed inside the case 52 coaxially with the case 52. Note that the periphery of the through-hole 56A is sealed so that the oil L does not leak.

Further, in a plan view, the projecting length of the partition wall 54 toward the center and the projecting length of the blade member 39 along the radial direction are slightly shorter than a length obtained by subtracting the radius of the fixing shaft 37 from the radius of the case 52 on its inner peripheral side. That is, the partition wall 54 and the blade member 39 are formed to have respective lengths that allow them to overlap each other in the radial direction.

Accordingly, even if the fixing shaft 37 is to rotate inside the case 52, the oil L present between the blade member 39 and the partition wall 54 serves as a rotational resistance. Thus, the fixing shaft 37 does not rotate when the fixing shaft 37 receives an input of a load (impact energy) less than the predetermined value (e.g., 250 N). In the meantime, the fixing shaft 37 is configured to rotate against the rotational resistance when the fixing shaft 37 receives an input of a load equal to or more than the predetermined value. That is, the damper mechanism 50 functions as an oil damper.

With the damper mechanism 50 configured as described above, when a load equal to or more than the predetermined value (e.g., 250 N) is input from the occupant P into the hand rail 30 toward the front side, the fixing shaft 37 rotates against the rotational resistance caused by the oil L and allows the hand rail 30 to rotate, as described above, for example.

Hereby, at least part of the load (impact energy) input into the hand rail 30 is absorbed by the damper mechanism 50 that allows the hand rail 30 to rotate, thereby reducing an injury level to be received by the occupant P from the hand rail 30. That is, even when an inertia directed forward is applied to the occupant P of the wheelchair 40 due to a collision or the like of the bus 10, it is possible to relieve an impact to be received by the occupant P from the hand rail 30.

The bus (wheelchair carrying vehicle) 10 according to the present embodiment has been described above with reference to the drawings. However, the bus (wheelchair carrying vehicle) 10 according to the present embodiment is not limited to the bus illustrated in the figures, and its design is modifiable appropriately within a range that does not deviate from the gist of the present disclosure. For example, the impact absorption mechanism is not limited to the aspects (the fixing shaft 36 as a torsion bar spring or the damper mechanism 50) illustrated in FIGS. 9A, 9B and FIGS. 10A, 10B. Further, the configuration to switch the hand rail 30 between the usage position and the stored position and to lock the hand rail 30 at the usage position is also not limited to the configuration described above.

Further, in a case of the hand rail 30 provided on the inner wall surface 26A side of the third pillar 26, a load is input from the occupant P of the wheelchair 40 into the hand rail 30 toward the front side at the time of a front end collision (or heavy braking) or the like of the bus 10, as described above. On this account, the support shaft 34 in this case is placed to be inclined outward in the vehicle width direction and forward from the vertical direction.

In the meantime, in a case of the hand rail 30 provided on the inner wall surface 24A side of the second pillar 24, a load is input from the occupant P of the wheelchair 40 into the hand rail 30 toward the rear side at the time of a rear end collision or the like of the bus 10. On this account, the support shaft 34 in this case is placed to be inclined outward in the vehicle width direction and rearward from the vertical direction.

Note that the bus 10 is not limited to the configuration including both an area in which the occupant P of the wheelchair 40 is seated in a forward facing posture and an area in which the occupant P of the wheelchair 40 is seated in a rearward facing posture. That is, the bus 10 may have a configuration including either the area in which the occupant P of the wheelchair 40 is seated in a forward facing posture or the area in which the occupant P of the wheelchair 40 is seated in a rearward facing posture. That is, the bus 10 is provided with at least either one of the hand rail 30 for the occupant P of the wheelchair 40 who is seated in a forward facing posture and the hand rail 30 for the occupant P of the wheelchair 40 who is seated in a rearward facing posture.

Further, the front seats 46 and the rear seats 48 may be foldable seats. In this case, the positioning portions with which the main wheels 42 of the wheelchairs 40 are brought into contact should be set appropriately in the folded front seats 46 and the folded rear seats 48. Further, the wheelchair 40 may be configured such that, after the wheelchair 40 is positioned by the positioning portion 46B of the front seat 46 or the positioning portion 48B of the rear seat 48, the wheelchair 40 is fixed by a seat belt device (not shown) or the like provided in the vehicle cabin 18.

What is claimed is:

1. A wheelchair carrying vehicle comprising:

a hand rail provided in a support shaft, the hand rail being configured to be switchable between a usage position and a stored position when the support shaft rotates, the usage position being a position where the hand rail is placed in a vicinity of a chest of an occupant of a wheelchair, the stored position being a position where the hand rail is placed along a side wall of a vehicle cabin; and an impact absorption mechanism configured to, when a load equal to or more than a predetermined value is input from the occupant into the hand rail placed and fixed at the usage position, absorb at least part of the load by rotating the hand rail.

2. The wheelchair carrying vehicle according to claim 1, wherein the impact absorption mechanism is provided in the support shaft.

3. The wheelchair carrying vehicle according to claim 1, wherein the hand rail is configured to rotate to a vicinity of knees of the occupant when the load equal to or more than the predetermined value is input into the hand rail.

4. The wheelchair carrying vehicle according to claim 3, wherein:

the hand rail includes at least either one of a hand rail for an occupant of a wheelchair who is seated in a forward facing posture relative to an advancing direction and a hand rail for an occupant of a wheelchair who is seated in a rearward facing posture relative to the advancing direction;

the support shaft provided with the hand rail for the occupant of the wheelchair who is seated in a forward facing posture is inclined outward in a vehicle width direction and forward in a vehicle front-rear direction from a vertical direction; and the support shaft provided with the hand rail for the occupant of the wheelchair who is seated in a rearward facing posture is inclined outward in the vehicle width direction and rearward in the vehicle front-rear direction from the vertical direction.

* * * * *